US008662829B2

(12) United States Patent
Pasquesi et al.

(10) Patent No.: US 8,662,829 B2
(45) Date of Patent: Mar. 4, 2014

(54) PUMP GUARD ADAPTOR, SYSTEM AND METHOD OF ADAPTATION THEREOF

(75) Inventors: John Pasquesi, Lake Forest, IL (US); Daniel P. Brown, Palos Park, IL (US)

(73) Assignee: Pit Boss Products, LLC, Lake Forest, IL (US)

( * ) Notice: Subject to any disclaimer, the term of this patent is extended or adjusted under 35 U.S.C. 154(b) by 714 days.

(21) Appl. No.: 12/970,656

(22) Filed: Dec. 16, 2010

(65) Prior Publication Data

US 2011/0206497 A1 Aug. 25, 2011

Related U.S. Application Data

(60) Provisional application No. 61/306,128, filed on Feb. 19, 2010.

(51) Int. Cl.
*F04D 29/70* (2006.01)

(52) U.S. Cl.
USPC ..... 415/121.2; 416/247 R; 417/313

(58) Field of Classification Search
USPC ..... 415/121.1, 121.2; 416/247 R
See application file for complete search history.

(56) References Cited

U.S. PATENT DOCUMENTS

| | | | | |
|---|---|---|---|---|
| 2,295,982 | A | 9/1942 | Widman | |
| 3,163,116 | A | 12/1964 | McCourty et al. | |
| 3,264,999 | A | 8/1966 | Tutthill | |
| 4,080,104 | A | 3/1978 | Brown, Jr. | |
| 5,249,930 | A | 10/1993 | Pacquesi | |
| 5,927,955 | A | 7/1999 | Janesky | |
| 6,179,558 | B1 | 1/2001 | Eastman, III et al. | |
| 6,209,593 | B1 | 4/2001 | Nichols, Sr. | |
| 6,308,924 | B1 | 10/2001 | Janesky | |
| 6,401,829 | B1 | 6/2002 | Newton | |
| 6,638,435 | B2 | 10/2003 | Loreno | |
| 7,025,574 | B2 | 4/2006 | Cremer et al. | |
| 2006/0093492 | A1 | 5/2006 | Janesky | |
| 2009/0183785 | A1 * | 7/2009 | Cole et al. | 137/363 |

FOREIGN PATENT DOCUMENTS

WO PCT/KR2002/00302 1/2003

* cited by examiner

*Primary Examiner* — Edward Look
*Assistant Examiner* — Aaron R Eastman
(74) *Attorney, Agent, or Firm* — Vedder Price P.C.

(57) ABSTRACT

The present disclosure relates generally to a sump pump guard adaptor, system, and method of adapting thereof, and more particularly to an inlet pre-screen cover also acting as a platform for pit positioning of a pump, a platform for adapting multiple pumps made to adapt over the inlet of sump pumps of different size to be configured into sump pits also of varied size. The adaptor can be adapted using a base connected to a top portion or simply a top portion also called the adaptor itself. The design also includes a plurality of flow openings that allow for easy cutting or bending of different portions of the adaptor for example on the inner and outer radii of the adaptor, a multi-segment design for better stacking and storage in a compact configuration, a plurality of pipe openings for use in a staked sump pumps configuration, an access doors to help lower the sump pump into the adaptor, and an adaptor with a secondary pump support built in the main body or as an external piece adaptable to the main body.

29 Claims, 15 Drawing Sheets

PUMP GUARD ADAPTOR, SYSTEM AND METHOD OF ADAPTATION THEREOF

CROSS-REFERENCE TO RELATED APPLICATIONS

The present patent application claims priority from and the benefit of U.S. Provisional Patent Application No. 61/306,128, filed Feb. 19, 2010, entitled Pump Guard Adaptor, which prior application is hereby incorporated herein by reference.

FIELD OF THE DISCLOSURE

The present disclosure relates generally to standalone and/or stackable, modular pump guard adaptor acting as a support and pre-screen to sump pump inlets, and more particularly, to a pump guard adaptor and base designed for easy onsite manual adaptation to the inlet of a sump pump for protecting pumps from movements and walking or piping vibrations, debris accumulations, shocks, and blockage in the operating pathways of different configurations.

BACKGROUND OF THE INVENTION

Pumps are devices used to move fluids, such as liquids, gases or slurries from one location to the next. A pump generally has a element placed in the flow of the fluid connected to a motor. When the motor is energized, the element rotates or moves pushing the fluid along a conduit. There are many types of pumps for many different types of applications.

Aside from the human heart, one of the most common type of pump is a sump pump used in basement of homes to push water and other fluids accumulated in a sump pit where the sump pump rests. There are several types of sump pumps such as pedestal pumps or submersible pumps. In a pedestal sump pump, the pump's motor is mounted above the sump pit, where it can be serviced and connected to the electrical circuit. The submersible pump on the other hand is mounted inside the pit and is sealed to prevent electrical short circuits. Sump pumps system can also be used in industrial and commercial applications. Wells can also use sump pumps.

While this disclosures generally will describe an adaptor for a "sump pump" it is understood that the adaptor can be used on any type of pump or system having a fluid inlet with or without a screen or that requires screening or pre-screening to limit the entry of solid particles into the fluid or the blocking of the screen or pre-screen by solid particles of a certain size or to create a dead volume around the inlet of the pump or system where fluid can accumulate.

Many sump pumps are small and designed with a 200 or 400 Watts pump to be used in a 2 to 3 feet pit holding 15 to 25 gallons of fluid. Pipes, typically 1.5 inch in diameter of PCV are routed from and to the pump through a check valve to control the flow of fluid through the pipe to prevent backward flow back to the sump pump. A sump pump, generally smaller in size than the pit in which it is lowered can rest freely on the bottom of the pit waiting for immersion before it is energized once a sensor measures fluid to be pumped out of the pit. Further, it is now becoming more common that pumps are configured with a redundancy system such as a secondary back up pump positioned in close proximity to the main pumping system. Legacy pits were designed for a single pump and therefore, important problems of configuration, sizing, and using multiple pumps in a single pit have arisen.

Suggested maintenance of sump pumps include an annual visual examination and cleaning by removing any debris that has accumulated in the proximity of the inlet of the sump pump. For example, if a tissue or other large object finds its way into the pit and blocks the screen on the pump, the pump may heat up and get damaged or simply be unable to pump water who may raise and flow out of the sump pit and flood a basement. Further, pumps under external stresses such as repetitive starts and stops or vibrations will "walk" to different positions and therefore joints are weakened and may burst creating further opportunity for leakage and flooding of a basement. Further, pumps that no longer are positioned as originally intended as a consequence of the "walking" may suffer from loss in efficiency by trapping the float control mechanism against the pit wall rendering it inoperable.

Often, plumbers or other maintenance personnel observe frequent problems with any single pump resulting in frequent calls. What is needed is method and device that can limit inlet blockage, protect float control mechanisms, or protect against "walking" problems and facilitate the addition or placement of back-up pumping systems. What is also needed is for a device, system, and method for reducing failure and the need for maintenance of sump pumps taking into consideration the fact that no two sump pump and sump pit are alike and that because of this large range in configurations, a design that accommodates all existing and possible configurations and sizes of pumps and pits is required.

SUMMARY

The present disclosure relates generally to a sump pump guard adaptor, system, and method of adapting thereof, and more particularly to an inlet pre-screen cover also acting as a platform for pit positioning of a pump, a platform for adapting multiple pumps made to adapt over the inlet of sump pumps of different size to be configured into sump pits also of varied size. The adaptor can be adapted using a base connected to a top portion or simply a top portion also called the adaptor itself. The design also includes a plurality of flow openings that allow for easy cutting or bending of different portions of the adaptor for example on the inner and outer radii of the adaptor, a multi-segment design for better stacking and storage in a compact configuration, a plurality of pipe openings for use in a staked sump pumps configuration, an access doors to help lower the sump pump into the adaptor, and an adaptor with a secondary pump support built in the main body or as an external piece adaptable to the main body.

BRIEF DESCRIPTION OF THE DRAWINGS

Certain embodiments are shown in the drawings. However, it is understood that the present disclosure is not limited to the arrangements and instrumentality shown in the attached drawings, wherein.

DETAILED DESCRIPTION OF THE INVENTION

Figure 1:
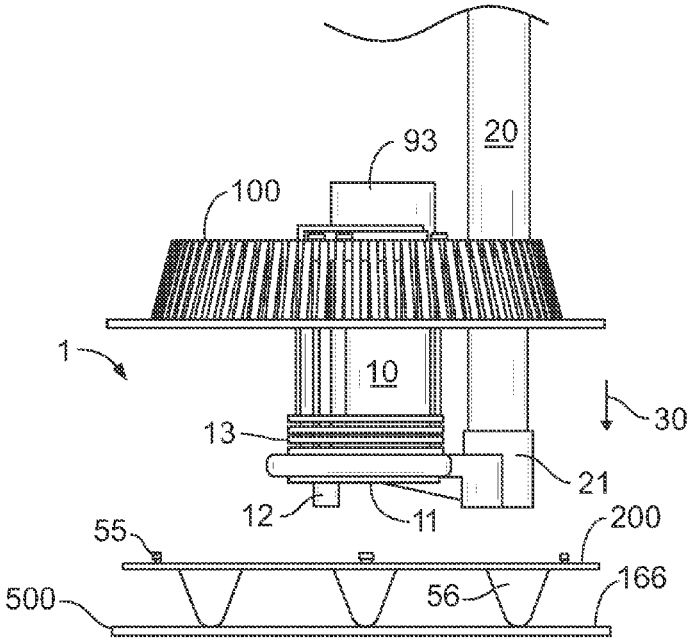
FIGS. 1 and 2 are two side dynamic animation views of a first configuration of the sump pump guard adaptor having a base and a top portion mounted on a sump pump.

For the purposes of promoting and understanding the invention and principles disclosed herein, reference is now made to the preferred embodiments illustrated in the drawings, and specific language is used to describe the same. It is nevertheless understood that no limitation of the scope of the invention is thereby intended. Such alterations and further modifications in the illustrated devices and such further applications of the principles disclosed as illustrated herein are contemplated as would normally occur to one skilled in the art to which this disclosure relates.

The pump guard adaptor provides the ability to locate a wide range of pumps of different sizes and configurations into also a wide range of pits of different sizes and configurations. This configuration needed to penetrate widely a mass market either at retail or at Original Equipment Manufacturer (OEM) or even at business to business.

Figure 2:
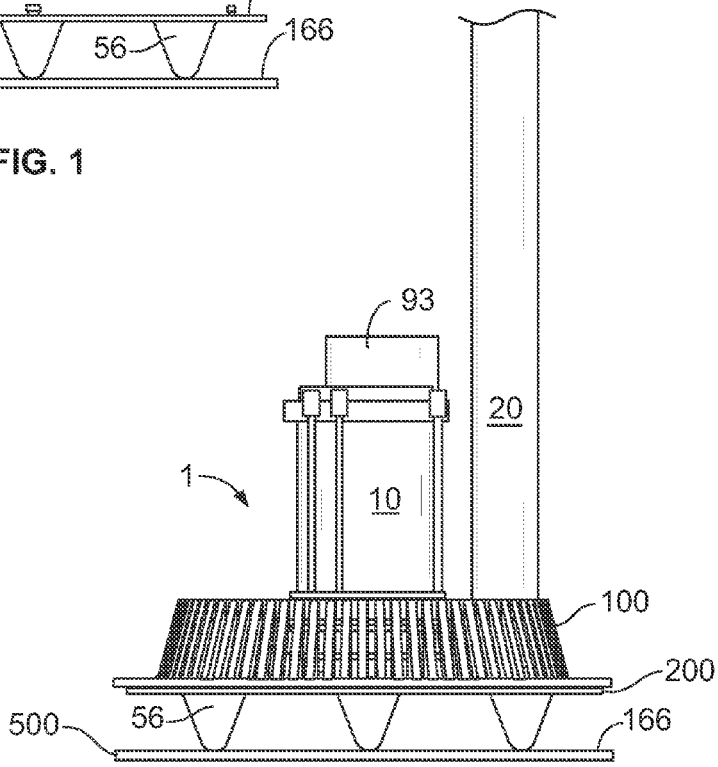
Figure 7:
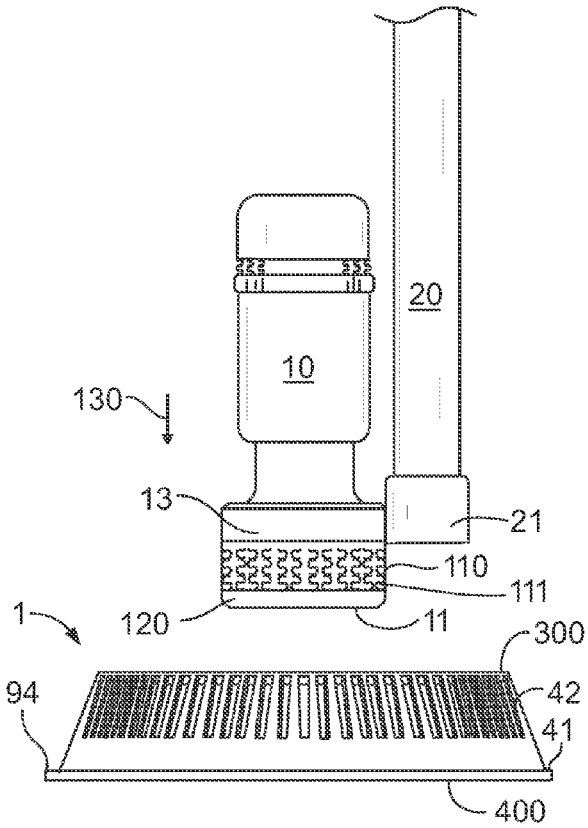
FIGS. 7 and 8 are two side dynamic animation views of a second configuration of sump pump guard adaptor mounted on a sump pump.
Figure 8:
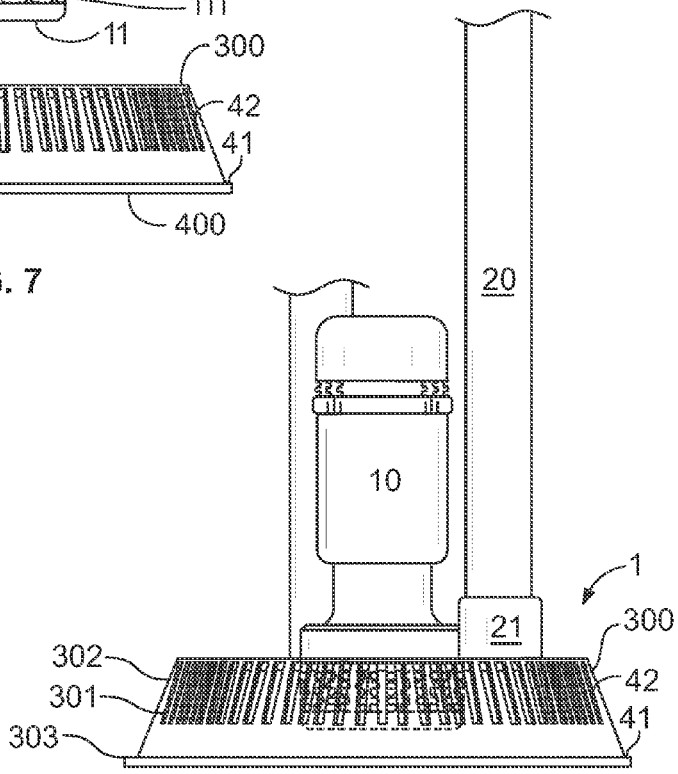

FIGS. 1 and 2 illustrate a first possible embodiment of the sump pump guard adaptor 1 as mounted on a sump pump 10. Other embodiments are shown in the different other figures and will described in turn, for example FIGS. 7 and 8 show a second embodiment of the pump guard adaptor 1 also mounted on a pump 10 without a base. As shown, the sump pump adaptor 1 is thin walled device that is bent or molded of a material that allows for easy manufacture and modification using simple commercial tools. In one embodiment, molded plastic is used, but other materials such as aluminum, steel, stainless steel, galvanized steel, polymers, and even transparent/non transparent, or even semi-transparent composites are contemplated. One of ordinary skill in the art will understand that the choice of material, may vary based on the anticipated use of the sump pump adaptor 1, for example, if used in the chemistry industry, a polymer that is not subject to chemical degradation may be used.

Figure 13:
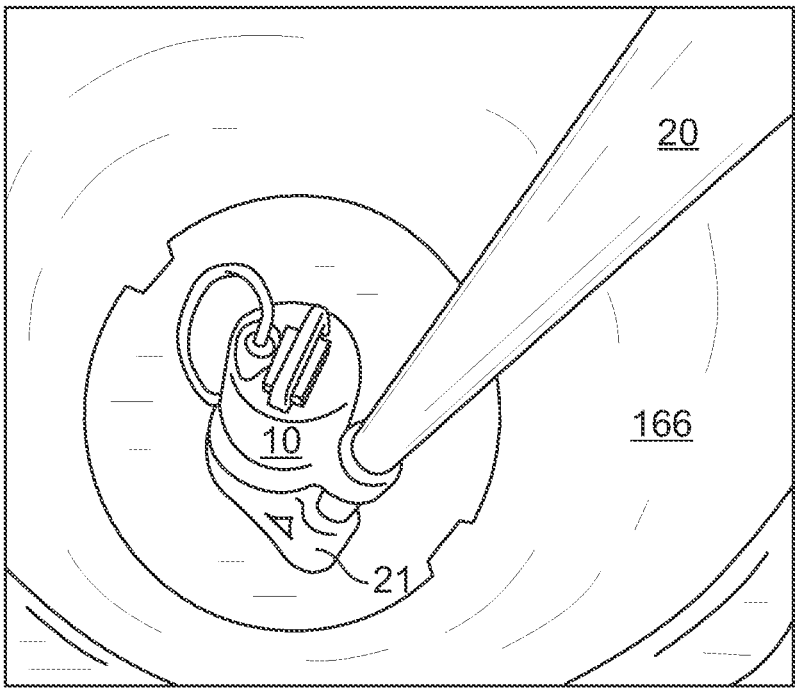
FIG. 13 is a first illustration showing a sump pump without a sump pump guard adaptor inside of a sump pit from four animated steps of a method of adapting a sump pump guard adaptor to a sump pump in a sump pit.

As for at FIG. 1, the pump 10 includes an inlet 13, a pump base 11, an outlet 20 such as an ejector pipe. In submersible pumps, the entire pump is lowered into a volume where the liquid is found such as a sump pit. FIG. 13 for example shows a pump 10 into a sump pit 166. The pit volume can also include materials place or accumulated on the side or the bottom such as gravel, rocks, or earth that is impregnated in the fluid to be removed.

One of the problems with pumping is the presence of debris or particles in the fluid that may lead to clogging at or around the pump base 11, and the inlet 13. In one embodiment as shown at FIG. 7, the pump inlet 13 may be covered by a screen 110 with openings 111. When a pump 10 encounters a liquid volume of debris (not shown) because of external conditions, the liquid to be pumped must move between the interstices of the screen 110 before it reaches the inlet 113. As this fluid is drawn into the pump 10, some of the debris is pre-screened and blocks the openings 111. A blockage at the inlet 113 limits the ability of a pump to drain any given pit. Sump pumps 10 are capable of moving some level of debris along with the fluid they carry and normally openings 111 of screen 110 are sized accordingly.

Once the screen 111 becomes blocked with debris, the pump is rendered inoperable. Either air can seep into the system, or the system begins to pull water through the substrate, creating resistance that lowers the flow. In normal sump pump systems, an accident or a rainy condition occurs and results in large volumes of water migrating to the sump pit 166. This flow can bring debris, tissues, or any other body that can obstruct the performance of the sump pump inside the sump pit 166. Damage is expected at the motor of a pump 10 when insufficient flow enters the inlet 113 from blockage, resulting in extended periods of operations for failure to draw the fluid to a level where pumping is no longer required, a condition that ultimately results in motor burn.

Figure 20:
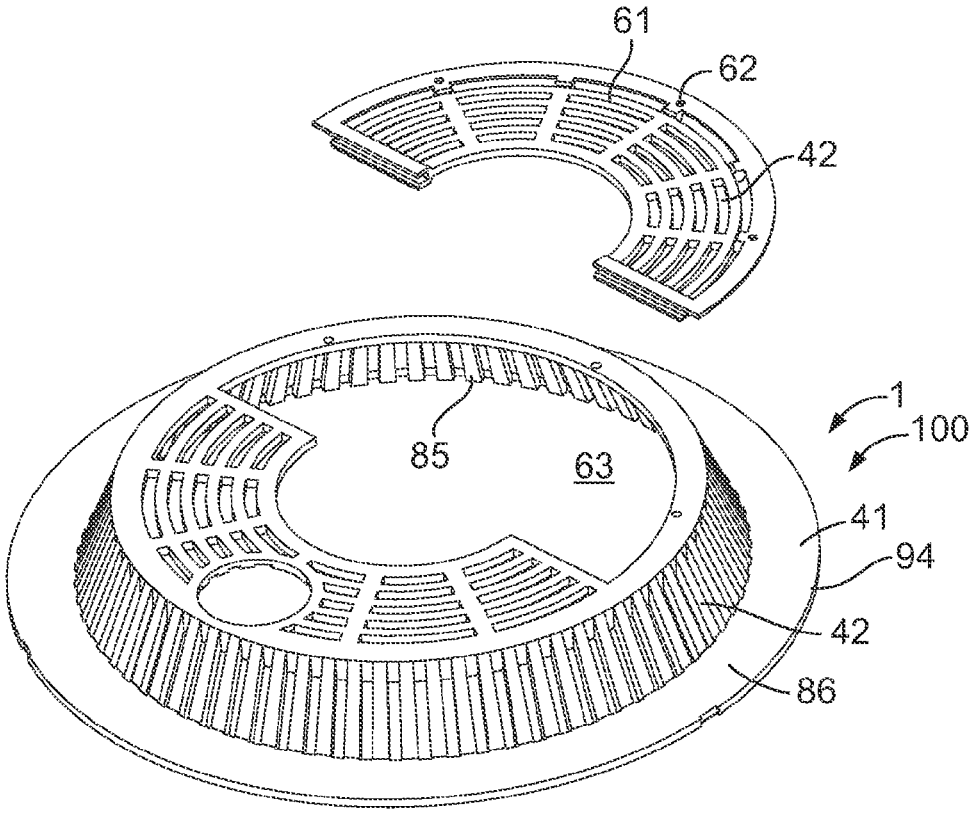
FIG. 20 is a perspective exploded view of a sump pump guard adaptor with an access door or plate according to another embodiment of the present disclosure.
Figure 21:
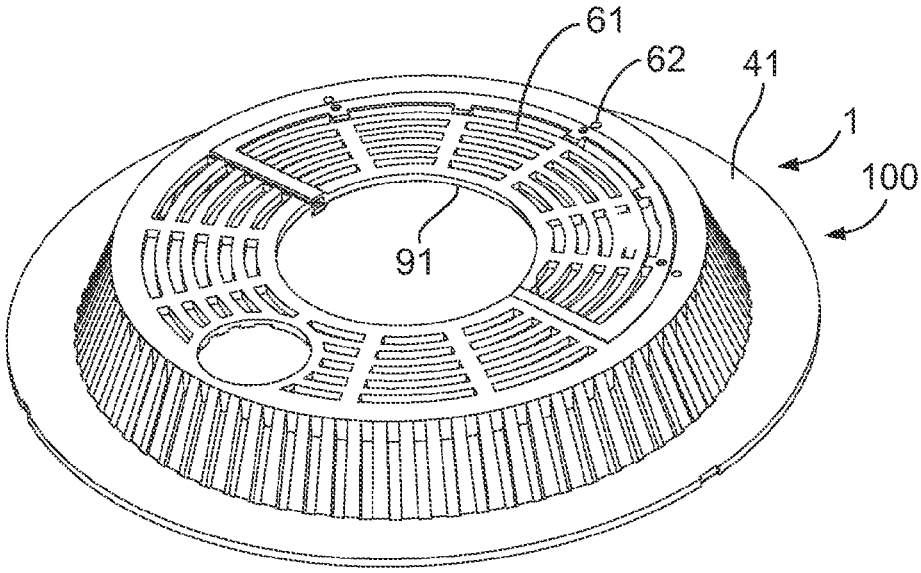
FIG. 21 is a perspective view of the sump pump guard adaptor with an access door of FIG. 20 with the door in place on the adaptor according to another embodiment of the present disclosure.

FIG. 1 shows how the pump 10 with the inlet 13 and the outlet 20 such as an ejector pipe with a connector 21 is lowered 30 into position. The pump guard adaptor 1 as shown is made of a body 100 and/or alternatively a base 200. As shown in FIG. 2, the body 100 is positioned onto the base 200 and encases the inlet 11 of the pump 10 using positioning holders, clips, or the like. In one configuration shown at FIG. 20, or 21, to help encase the inlet 11 of the pump 10 to the body 100, a door 61 is used. This door can, as shown cover 180 degrees of the top portion of the body 100 and be attached with small screws 62 or other securing means. In another configuration, the door clips into place with a push.

The door or plate 61 creates an opening 63 of sufficient size to allow the insertion of the pump 10 and any casing around the pump 10. In another embodiment shown at FIGS. 22-24, the body 100 is made of segments 141, in this case shown as 90 degree segments 141 each secured to the next by a series of bolts, snap or even interlocking lips 72. Once again, while one configuration is shown, what is contemplated is the use of many different configurations and segments 141 each with different angles or portions that can be clipped in, attached, merged in, screwed in place in order to recreate the body 100.

Figure 25:
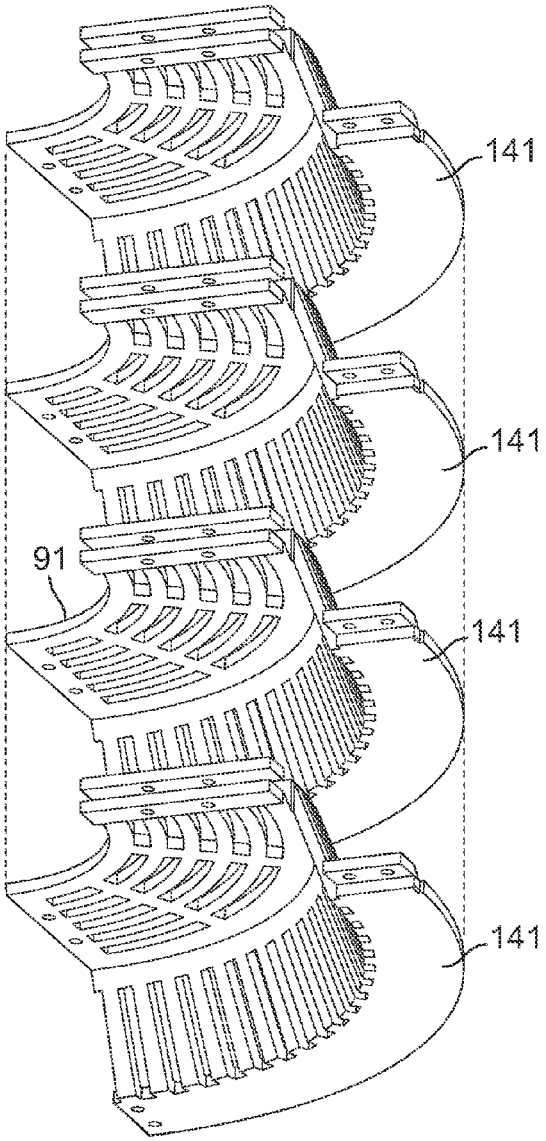
FIGS. 25 and 26 are views showing how the different segments of the sump pump guard adaptor of FIG. 22 can be staked.
Figure 26:
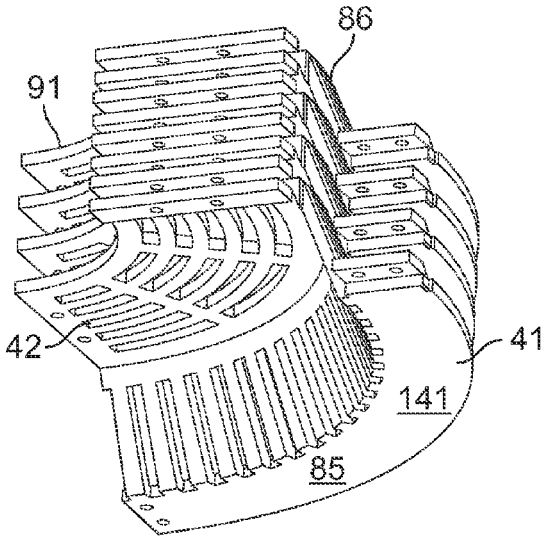

At FIGS. 25 and 26, what is shown is one of the numerous advantages of using different segments 141 to form the body 100 as each of these segments 141 can be stored and stacked for easily manipulation or packaging for shipment. For example, pumps sold in boxes with a small footprint can include a group of segments 141 within the box without increase in overall cube or shipping volume of the box caused by the adaptor. As a further advantage, if the user cuts out the wrong portion of the segment during adaptation to the sump pump 10, then only a segment 141 can be discarded.

Figure 12:
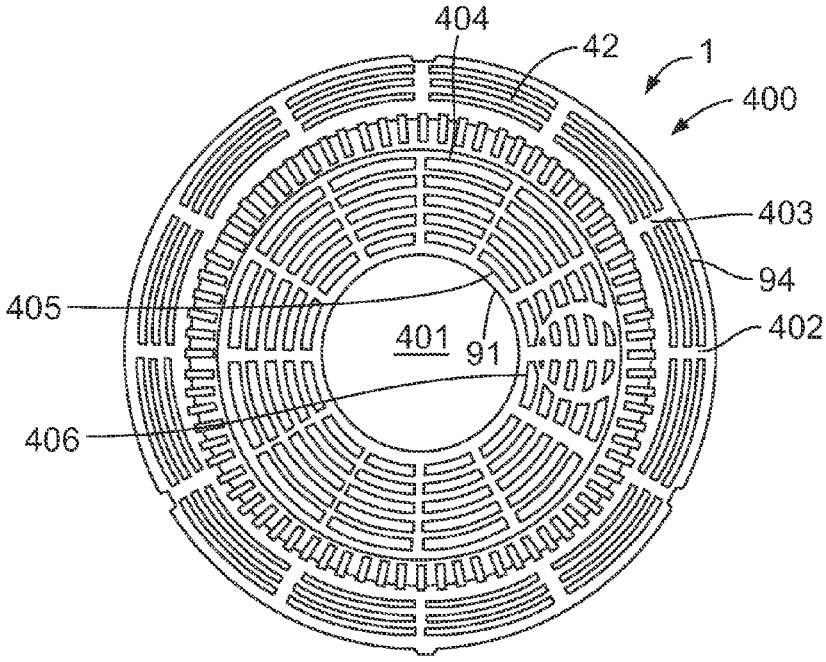
FIG. 12 is a top view of the top portion of the sump pump guard adaptor of FIG. 11.

In one configuration shown in FIGS. 1 and 2, the pump guard adaptor 1 is made of two pieces clipped to form a single adaptor 1, the body 100 and the base 200. In this configuration, the base 200 protects the body 100, the inlet 11 and ultimately the pump guard adaptor 1 from accumulated debris that is present below the pump 10 and its inlet 11 in some of the pits including for example older generation pits. In another embodiment shown in FIGS. 7 and 8, the adaptor 1 is made of a single piece 300 that is made to rest on the pit bottom directly. While two possible configurations are shown, the use of any number of pieces to create an enclosure capable of creating a volume adjacent to the inlet 11 of a pump 10 where a liquid such as water can be collected is contemplated. FIG. 12 illustrates a body 400 with flow openings on different portions of the piece.

Figure 4:
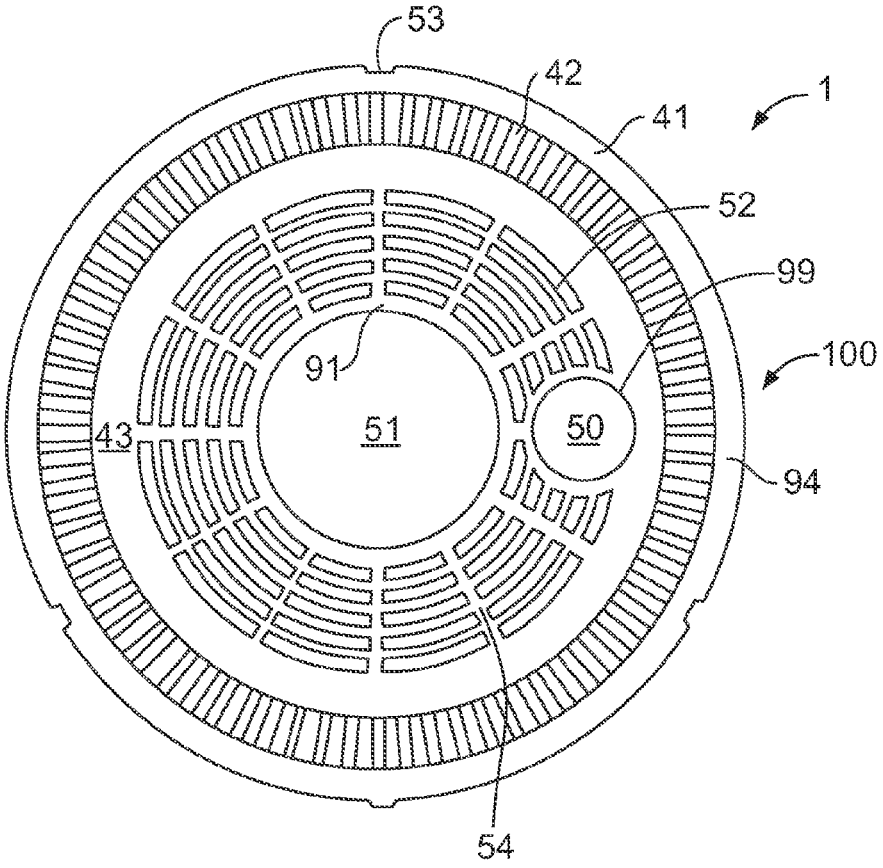
FIG. 4 is a top view of the top portion or the sump pump guard adaptor shown at FIG. 3.

Returning to FIG. 1, the pump 10 includes an inlet 13 in the shape of radial openings along the body of the pump 10 and can also include a plurality of structural devices for locking and attaching the pump 10 at a location. While one possible type of pump 10 and one possible type of attachment means 12 is shown, any mechanism designed to hold the pump 10 in place within the pump guard adaptor 10 is contemplated. The opening 51 as shown for example on FIG. 4, is centered within the guard adaptor 1, but what is contemplated is the placement of the opening 51 at any location on the adaptor 1 so as to support the pump 10 or pumps that must be secured in the adaptor 1.

Figure 3:
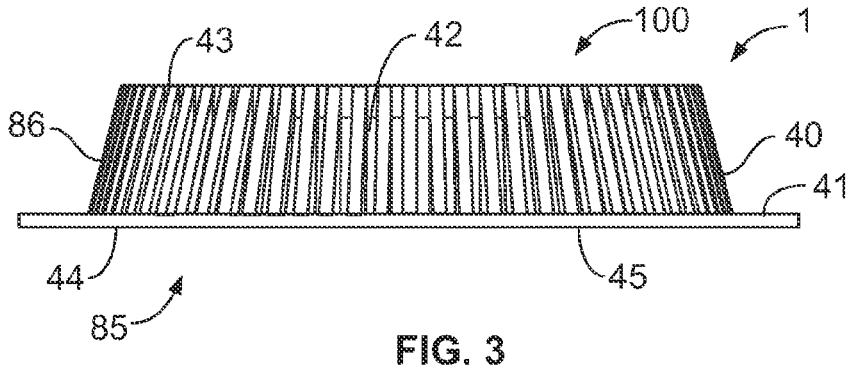
FIG. 3 is a plan elevation of the sump pump guard adaptor or the top portion of the sump pump guard adaptor of FIGS. 1 and 2.
Figure 11:
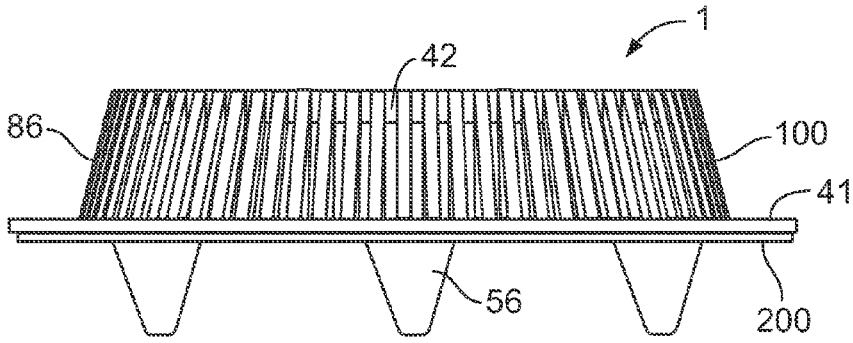
FIG. 11 is a plan elevation of another embodiment of the sump pump guard adaptor with a top portion and a base with flow openings on the horizontal lip of the top portion.
Figure 18:
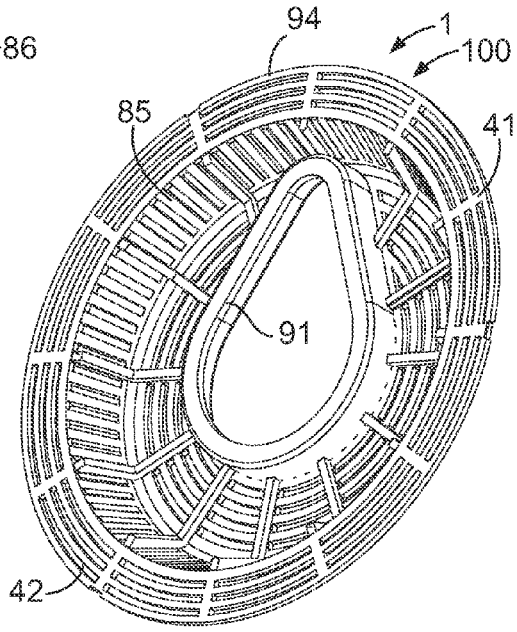

FIG. 3 is a elevation of the body 100 where a bottom horizontal lip 41 is shown with a bottom surface 44 for connection on the ground or to a base 200 as shown in FIG. 11. To allow for fluid to pass from the external surface of the body 40 to the inside of the body 100 and ultimately move to the inlet 13 of the pump 10, a series of flow openings 42 are made on the body 100. As shown, these openings may be in the shape of long rectangular strips with ribs from the upper plate 43 to the bottom horizontal lip 41. One of ordinary skill in the art will recognize that the flow openings 42 are made and have a geometry that is a compromise between giving the body 100 the greatest structural rigidity while keeping the openings as small as possible and allowing unimpeded flow of liquid through the body and by keeping the openings as large as possible. One way to rigidify the screen is to create angled bends, ribs, and other structural reinforcements as known in the art. FIG. 18 for example shows from the bottom surface of the body 100 reinforcement ribs 81 that can be used as reinforcements. Another way to rigidify the screen is to use stronger materials, such as stainless steel, metal, or rigid plastics, or to increase the thickness of the material in the screen.

Further, the flow openings 42 also serve to prevent the inflow transportation of the substrate, such as rocks and gravel, from outside the screen to inside the screen. If the flow openings 42 are of ⅛" in width, any rock with a diameter greater than ⅛" cannot flow into the body 100 and thus the adaptor 1. What is also contemplated is the use of openings of a size that disallows small rocks from getting stuck in the flow openings 42. For example, in one embodiment, instead of circular flow openings 42, long slit shaped openings 42 are made to allow for small rocks in contact with the opening to slide down under gravity once the suction of the pump 10 is stopped.

Further, structural strength is required of the adaptor 1 both to prevent collapse under the external weight of the substrate and to prevent collapse caused by the suction from the inlet 11 of the pump 10. FIG. 4 is a top view (or a bottom view) of the body 100 of FIG. 3 illustrating a possible arrangement of the different flow openings 42. Radial slits are found on the outer angled edge connecting the upper plate 43 with the horizontal lip 41. Other openings are made 52 on the top portion to allow for liquid to pass from a zone above the body 100 into the internal portion of the body 100. At FIG. 4, two further flow openings 51, 50 are made in the upper portion of the body 100 to allow for the passage 51 of the body of the pump 10 through the body 100 and for the passage 50 of the ejector guard 20 through the body 100. These openings 50, 51 are only illustrative in position, size, and orientation of possible passages made in the screen 100. One of ordinary skill in the art will recognize that the body of the pump 10 may be located inside the body 100, or the outlet 20 can be located sideways on the body 100.

Figure 5:
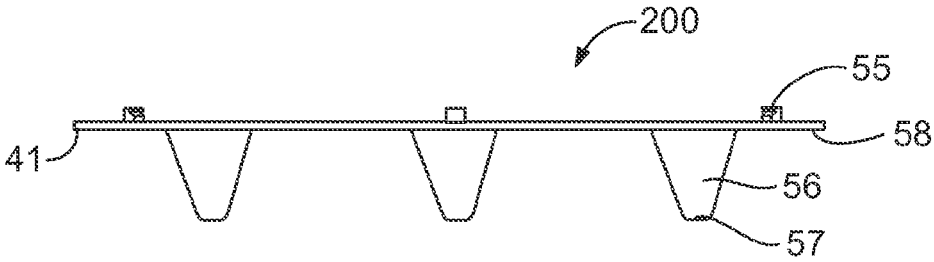
FIG. 5 is a plan elevation of the base of the sump pump guard adaptor shown in FIGS. 1 and 2.
Figure 6:
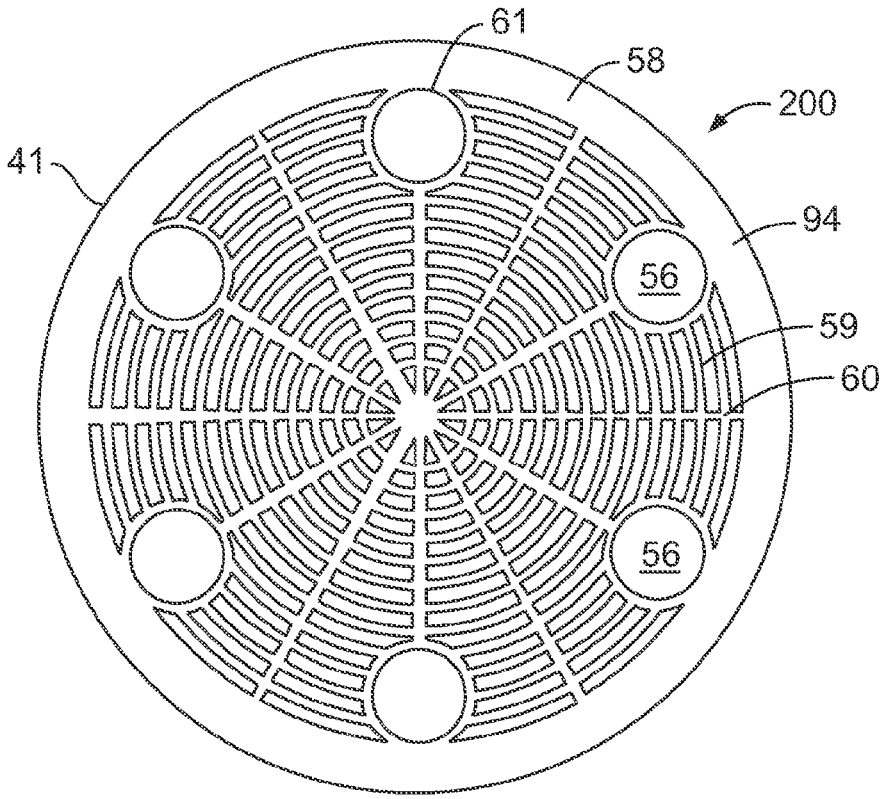
FIG. 6 is a top view of the base of the sump pump guard adaptor of FIG. 5.

FIG. 5 is a side view of the base 200. The base 200 in one embodiment is round and attaches to the horizontal lip 41 using tabs 55 that clip or attach onto the body 100 to encase the pump 10. Other types of attaching means are also contemplated along with a configuration where no attaching means is used. In one embodiment, the tabs 55 are self locking clips capable of locking after a push of the body 100 to the base 200. The base 200 also includes pods 56 shown as conical feet 57 connected to the under portion 58 of the base 200. One of the objects of the base 200 is to raise the body 100 off the ground to create an additional area for the infiltration of the liquid within the adaptor 1. For this reason, the base 200 as shown in FIG. 6 includes as many openings 59 as possible for the flow of fluid. Ribs 60, 61 are also present to reinforce structurally the base 200 to prevent collapse either from the weight of the pump 10 or the aspiration of the pump 10 creating a depression inside of the adaptor 1. FIG. 11 illustrates how the base 200 can be mounted below the body 100 to form the adaptor 1.

Once again, while the base 200 is shown as a flat plate with feet, the base can be made of any shape and size possible to support the body 100. In the structure shown at FIG. 12 and also used at FIG. 9, the body 100 encases the inlet 13 and includes a series of ribs 403, and 402 operating with flow openings 404, 405 to allow for the better passage of liquid. While the base 100 can be made not to include these openings, what is contemplated is a structure that can include a plurality of openings 401, 406 made directly into the bottom plate 400 or that can be cut in with a tool by a user for adaptation over any pump 10. What is contemplated is the use of any configuration of pump base or base, including, for example, a U-shaped cup having a flow opening with lips, to promote the passage of liquid in the screen, or even the molding or use of a male/female connector pipe where the screen 100 is slid as a male connector into the female pipe or vise versa (not shown).

As shown in FIGS. 7 and 8, the body 300 includes openings 301 that are not made from the top 302 to the bottom 303 of the body 300 but openings 301 that only occupy a portion of the lateral sides. This configuration allows for control of the flow of water into the adaptor 1 and prevent the accumulation of aggregates at the bottom of the adaptor 1. In one embodiment shown in FIG. 7, the pump 10 includes an integral filter, or a screen 110 located next to the inlet 13 of the pump 10. This screen 110 includes openings 111 and a support 120 for the passage of liquid. As shown in FIG. 8, in one embodiment, the openings 111 in the screen 110 can align with the openings 301 in the body 300 over the support 120. While one possible configuration is shown, the use of any type of openings 301 on the lateral, top or bottom surfaces of the body 300 to allow for the creation of an internal flow control volume in the body 300 is contemplated. Further, the use of a base or a bottom wall to close the body 300 next to the ground is not shown but is contemplated.

Figure 9:
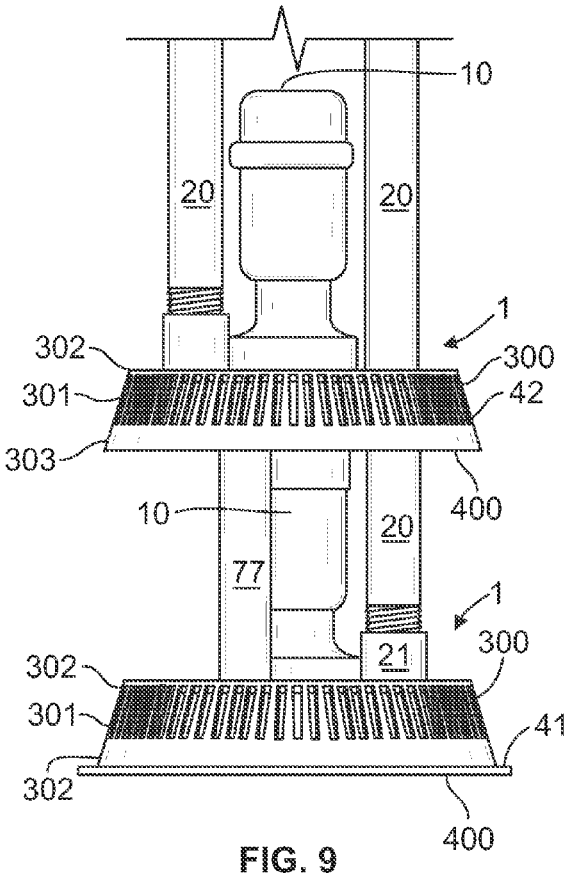
FIG. 9 is a plan elevation of two stacked sump pumps each equipped with a sump pump guard adaptor of FIGS. 7 and 8.
Figure 10:
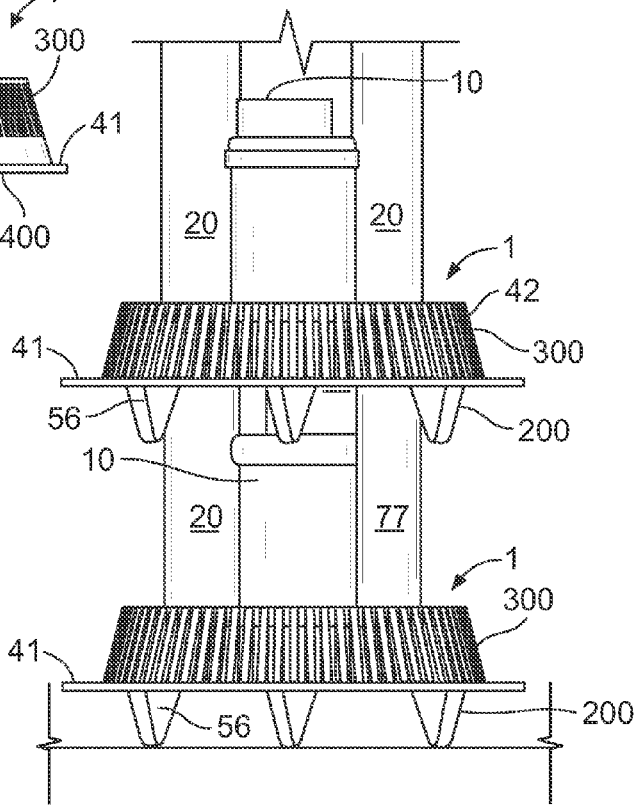
FIG. 10 is a plan elevation of two stacked sump pumps each equipped with a sump pump guard adaptor of FIGS. 1 and 2.

FIGS. 9 and 10 show how several pumps 10 can be stacked and equipped with adaptors 1 made of a one-piece body 300 or a two-piece body 100 and base 200. These configurations are directed to systems where back up pumping configurations or level pumping is required. Pumps 10 can be used in tandem either next to each other or on top of each other depending on the acceptable footprint given to the pumping system. For example, the configuration shown in FIGS. 9 and 10 is optimal for pumping in deep, cylindrical wells. Other holes can be made in the upper adaptors 1 for the passage of outlets 20 from pumps 10 located below an adaptor 1. These variations are also contemplated and disclosed herein. Further, support pipes 77 of similar structure to the common outlet pipes 20 can be used or other support structural elements can be used to stabilize multi-level pumping system. Once again, the adaptor 1 is designed to be versatile, include openings and tabs that can be placed on the adaptor 1 to help create an adaptor capable of attaching to any type of pump, in any configuration, over any surface.

Sales surfaces often cannot hold in stock hundreds of different types of adaptors but must be able to adapt to a very wide range of pumps. For this reason, the adaptor 1 is designed to function with the greatest majority of pumps on the market and are adapted to include openings for the passage of the pump body calibrated to accommodate the greatest proportion of commercial pumps. For example, in a field, if pumps have a body of 10, 20, and 25 inches, an opening can be designed with a 20 inch internal diameter for accommodation of the pump, with tabs of 5 inches that can be cut when the 20 inch internal diameter is needed, and where a ring of plastic or a cut off diameter at 25 inch is made in the screen.

Further, the underside of the base 200 can also be adapted to interlock with the upper side of a pump 10 when pumps are stacked vertically as shown in FIGS. 9 and 10. The pods 56 for lifting the base 200 off the ground are also designed as to be manually cut to specify the vertical clearance below the base 200 or to allow for partial removal for better ground stability on uneven ground, etc. The top surface of the body 100, 300 of the adaptor 1 can also be adapted to interlock with a second body 100, 300 for easier storage in a stacked configuration.

In several of the embodiments, what is disclosed is a sump pump guard adaptor 1 for a sump pump 10 with an inlet 13, the adaptor 1 comprising a body 100 with an inside surface for covering an inlet 13 of a sump pump 10 on which the body 100 is adapted. The body 100 also includes a plurality of flow openings 42 between the inside surface 85 and an outside surface 86 on the body 100.

The contact of opening 51 and the upper plate 43 as shown at FIG. 4 creates a first internal collar 91 also between the inside surface 85 and the outside surface 86 on the body 100 for the adaptation of the body 100 to a casing 93 of a sump pump 10. The body 100 of the adaptor 1 also includes an external edge 94 for adaptation of the body 100 to a base 200 or a bottom surface of a sump pump pit. In one embodiment, a horizontal lip 41 is located at the external edge 94 as shown at FIG. 4, and in yet another embodiment shown at FIG. 27, the external edge 94 includes tab elements 95 as shown of rectangular shape for easy access, bending and cutting using pliers or industrial cutters.

Figure 17:
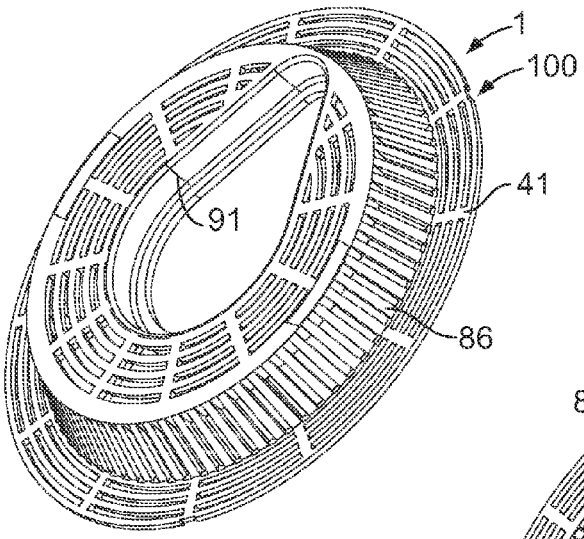
FIGS. 17, 18 and 19 are three perspective views of another embodiment of a sump pump guard adaptor with a drop shaped first collar according to another embodiment of the present disclosure.
Figure 19:
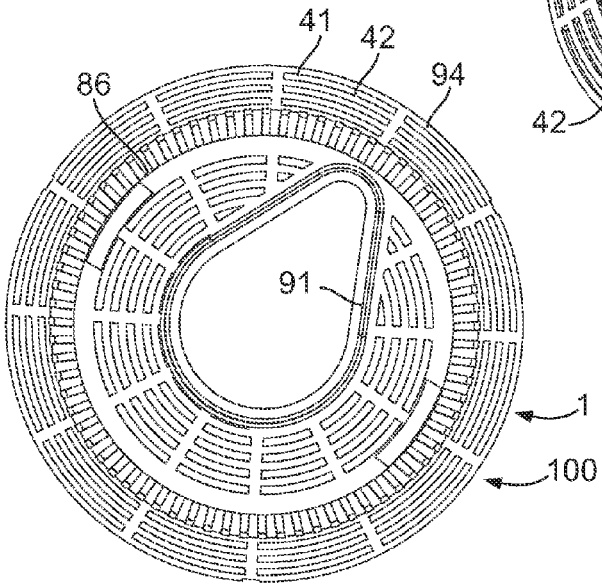
Figure 27:
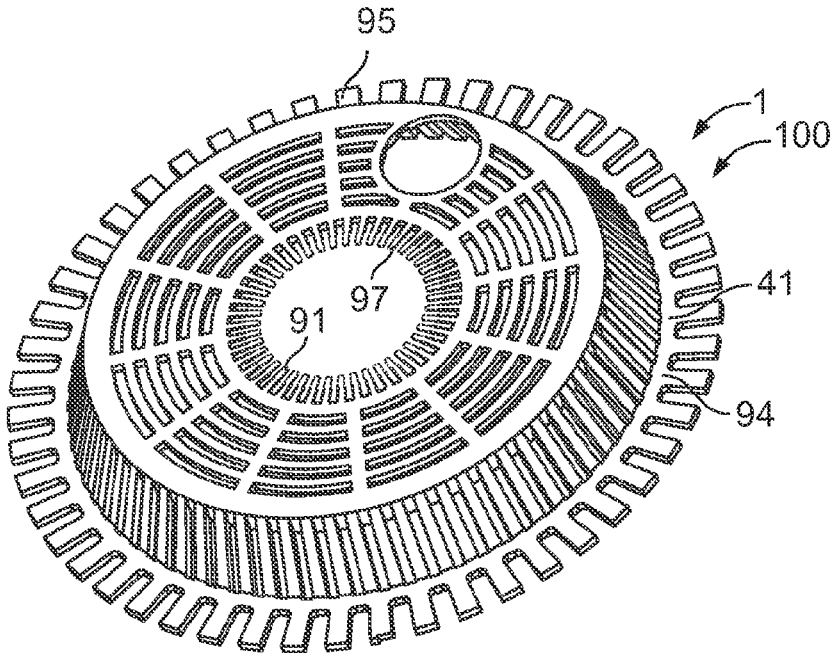
FIG. 27 is a perspective view of another sump pump guard adaptor with configurable adaptor elements and configurable tab elements according to another embodiment of the present disclosure.
Figure 28:
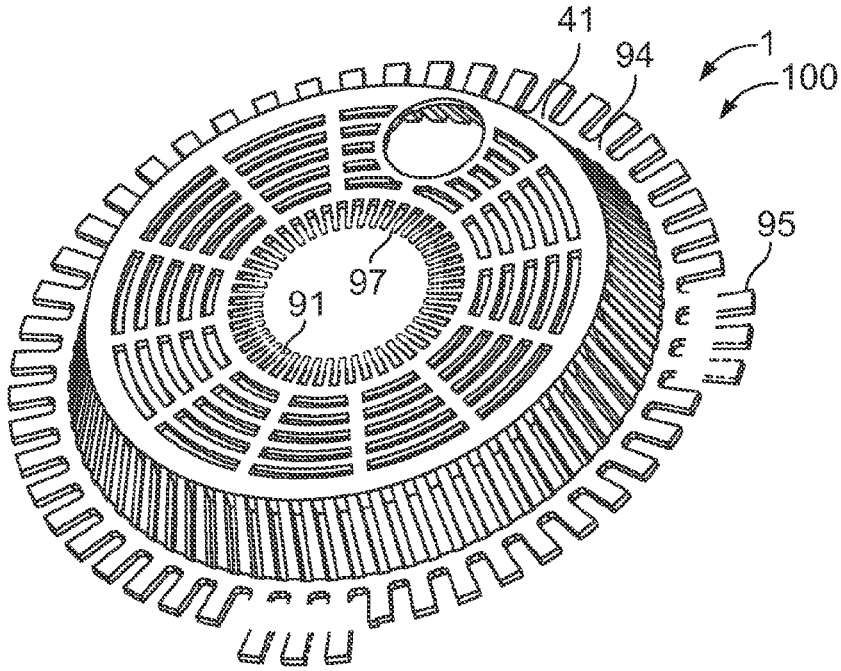
FIG. 28 is a view of the sump pump guard adaptor of FIG. 27 where some of the configurable adaptor elements and configurable tab elements have been cut for adaptation according to another embodiment of the present disclosure.

As shown on the different figures, the body 100 along with the base 200 or by itself when rested against a surface defines a transitory volume where the fluid can be collected or will transit defined between the inside surface 85 of the body 100 and either the base 200 or the bottom surface of the sum pump pit 500 on FIG. 1. Further, the flow openings 42 define a filter between the outside surface 86 and the inlet 13 as the fluid passes from the outside surface 86 in the pit, through the flow openings 42 and into the transitory volume before reaching the inlet 13 for pumping up by the pump 20. FIG. 27 also shows an adaptor 1 where the first internal collar 91 includes adaptor elements 97 also designed to be cut using a hand tool for rapid adaptation of the adaptor 1 to a pump 10. As shown on FIGS. 17-19, the first collar 91 can be reinforced and lowered by a small distance from the upper plate 43 of the body 100 of the adaptor 1.

In an alternate embodiment, the body 100 of the pump guard adaptor 1 includes a top portion and a base 100, and the first collar 91 is on the top portion. The first collar 91 as shown can also be formed as the result of the union of several segments 141 and where the first collar 91 is then located on more than one piece or segment 141.

At FIG. 4, the body 100 includes an ejector pipe adaptor 99 formed around the opening 50 between the inside surface 85 and the outside surface 86 and the inside surface 85 is adapted to be nested to the outside surface of a second sump pump adaptor either in segment 71 of as a whole (not shown). The nesting allows for a more efficient storage and display, and also broadens the commercial applications. For example, what is shown generally in this disclosure is a rounded shape adaptor 1 and sump pit 166. In Italy, the "pozzetti" or pit for drains is generally square in shape and therefore a different external shape can be optimal along with segments 141 of associated shape. What is also contemplated are different shapes capable of interlocking to create the transitory volume and act as a prefilter to the pump inlet 13.

In another configuration the body 100 of the adaptor 1 includes a second pipe adaptor (not shown) on the base for the passage of a pipe from a second pump 10 staked below the sump pump adaptor 1 as shown at FIGS. 9-10. What is also not shown but contemplated is the use of a strap or other external holding devices that can be slid into the different openings 42 of the adaptor 1 to secure the adaptor to the pump 10 or even to external elements.

Figure 14:
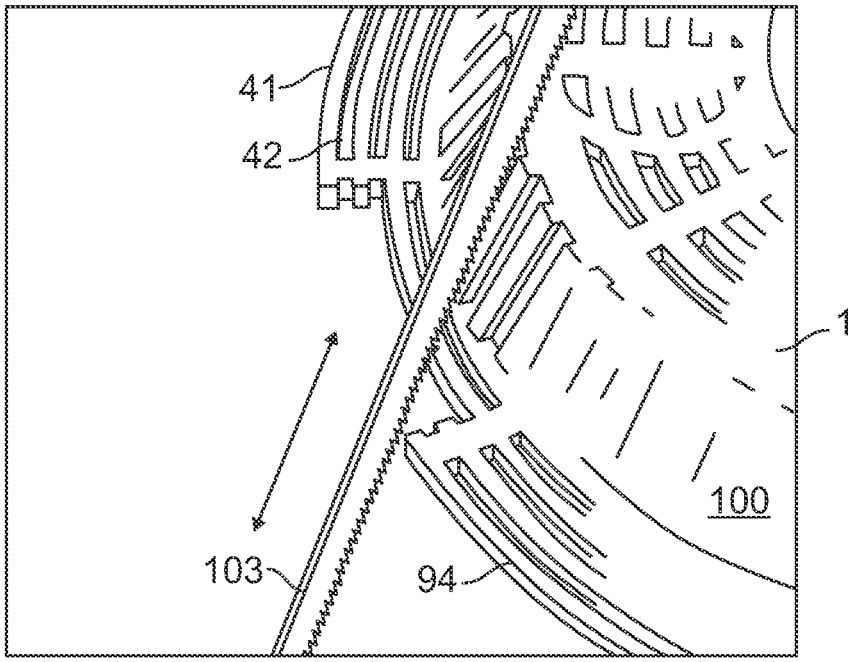
FIG. 14 is a second illustration showing the cutting of tab elements on a sump pump guard adaptor from four animated steps of a method of adapting a sump pump guard adaptor to a sum pump in a sump pit.
Figure 15:
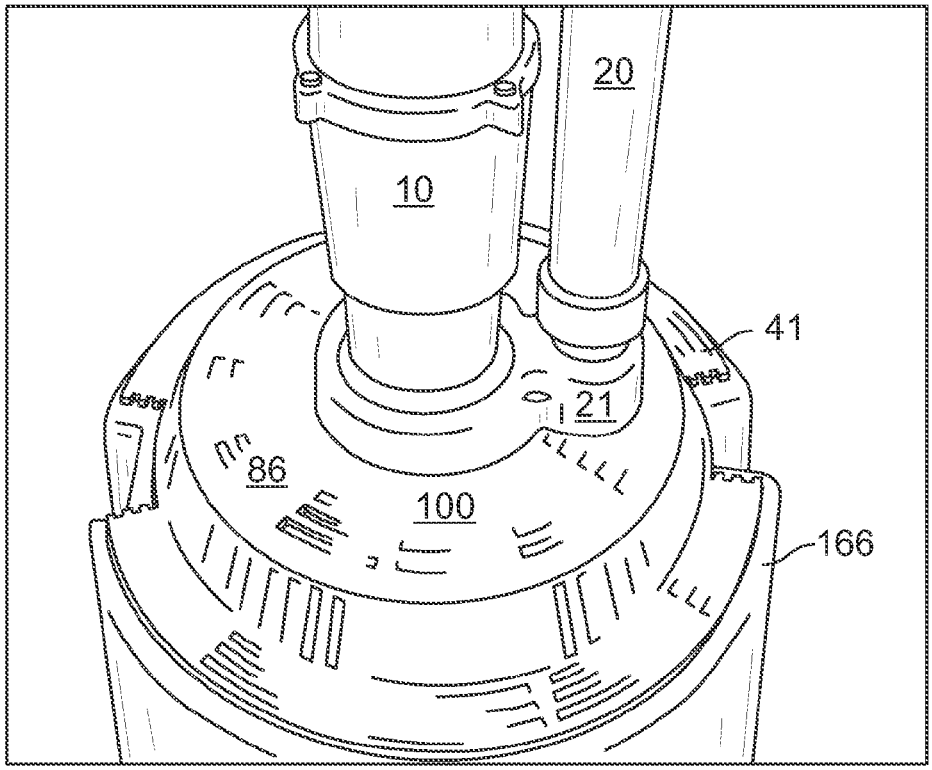
FIG. 15 is a third illustration showing the matching of field modifications of the adaptor resting on the bottom of an upside down pit where the structure is modified to accommodate with the configuration of the pit.

In another embodiment, the adaptor can be sold and advertise as part of a kit for securing a sump pump guard adaptor 1 to a sump pump 10. The kit can be sold as shown at FIG. 14 with a tool such as a saw 103 for cutting either the adaptor elements 97 or the tab elements 95 or even as shown any portion of the adaptor 1. The tool can also be any tool used by maintenance personnel who need to assemble an adaptor with segments 141 such as a screwdriver if screws or bolts 62 are used. The kit can also include a strap (not shown) to be slid to secure the body 100 to either the pump 10 or the sump pit 166. Further, the kit can include both a body 100 and a base 200, or several segments 141 forming the body 100 or even a larger quantity of segments 141, bases 200 or bodies 100.

Finally, what is also contemplated is a system for adapting what is considered a pre-screen 1 instead of a adaptor to the pump 10. The system can be included as part of a filtration system where a subsequent layer of filtration is needed. For example, instead of placing a new filter grid on the upper portion of a sump pit 166 if a user wants to filter against a specific size of debris, the pre-screen 1 can be used instead of the grid. The term pre-screen is used instead of the term adaptor as it serves a different function in the context of this disclosure while being related to the same structural elements. In terms of function of the device as contemplated, the adaptor is a piece that complement a pump or a pumping system to protect the pump and offer a flexibility to the pump. In contrast, the pre-screen serves primarily to control the flow of debris and screens as part of a filtration system can also be designed to offer a pressure drop to manage efficiently the flow of fluid through the filter. For example, if pumping at one sump pump is too important and must be reduced, a pre-screen can be used.

Figure 16:
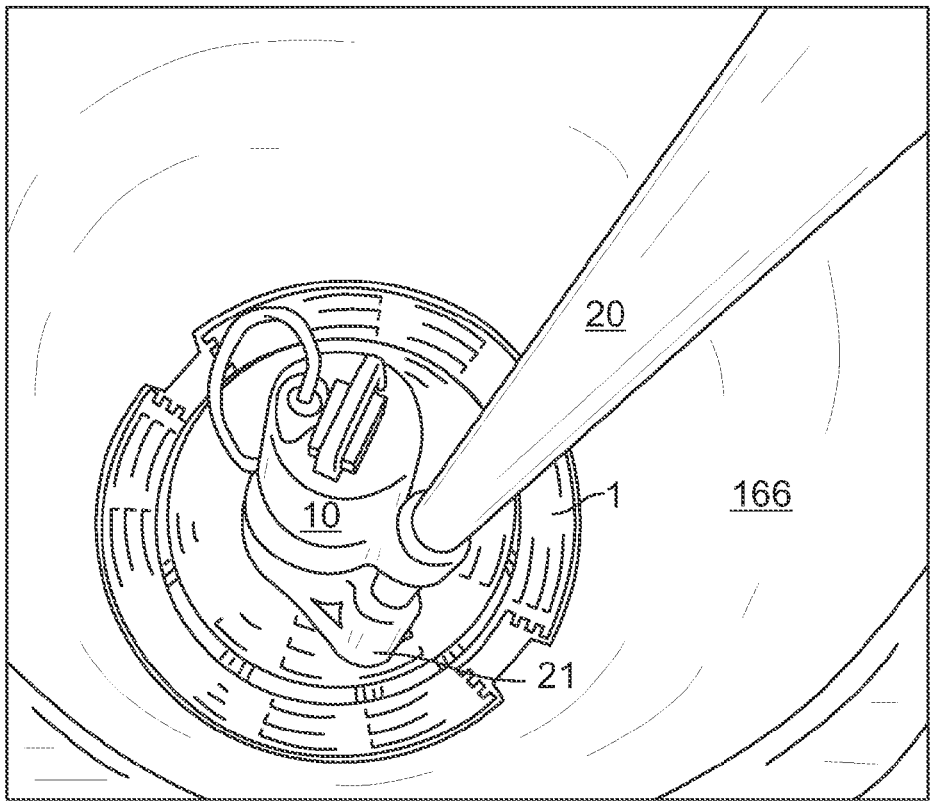
FIG. 16 is a fourth illustration showing the sump pump in position from four animated steps of a method of adapting a sump pump guard adaptor to a sump pump in a sump pit.

FIGS. 13 to 16 show using illustrations some of the steps as to how the pump guard adaptor 1 is adapted to a sump pump 10 inside of a sump pump pit 166. At FIG. 13, a sump pump 10 is shown at the bottom of a pit 166. At FIG. 14, an operator cuts using a tool such as a saw 103 a portion of the external edge 94 to remove some tab elements 95 in order to create a new external shape for the adaptor that will slide as shown at FIG. 14 into the irregular shape pit 166 a shown at FIG. 16. What is also claimed as part of this disclosure is a method of adapting a pump guard adaptor 1 to a sump pump 10, the method comprising the steps of: selecting a sump pump with an inlet 13 and a casing as shown at FIG. 13, the casing having a first external shape, selecting a pump guard adaptor 1 with a body 100 and a plurality of flow openings 42 on the body 100 for covering the inlet 13 within the body 100, the pump guard adaptor 1 having a first collar 91 for adaptation as shown at FIG. 14 to the first shape on the casing, and having an external edge 94 for adaptation to an internal surface of a sump pit 166, and as shown at FIG. 16 sliding the casing inside of the first collar 91, and sliding sump pump 10 with the pump guard adaptor 1 in the internal surface of the sump pit 166.

In an alternate embodiment, the first opening 91 further comprises adaptor elements 97, and wherein the method includes the step of cutting or bending the adaptor elements as shown at FIG. 27 to open the first collar 91 to the size of the casing before the step of sliding the body inside of the first collar.

Yet in another embodiment the method includes the step of selecting a pump guard adaptor 1 where the external edge 94 comprises tab elements 95, and wherein the method includes the step of cutting or bending the tab elements to narrow the external edge for adaptation to the internal surface of the sump pit 166 as shown at FIG. 14 before the step of sliding the sump pump with the pump guard adaptor in the internal surface of the sump pit 166. Finally, the method includes the placement of a base 200 to a top portion 100 (not shown) and wherein the method includes the step of attaching the base 200 to the top portion 200 after the step of sliding the casing inside the first collar.

Figure 22:
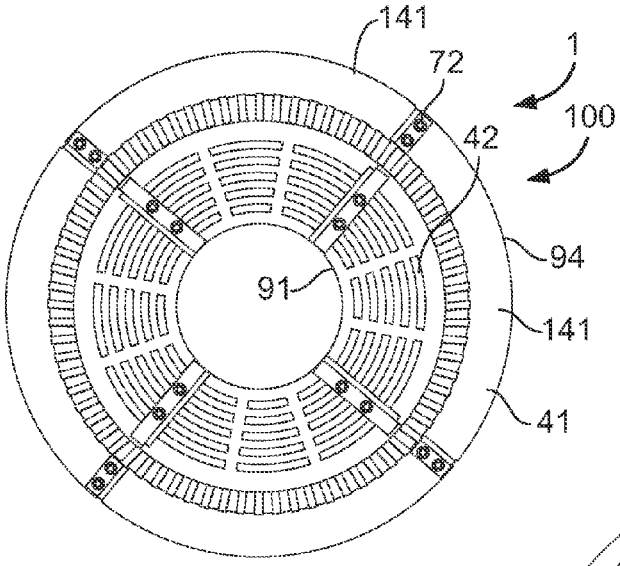
FIG. 22 is a top view of a sump pump guard adaptor made of several segments according to another embodiment of the present disclosure.
Figure 23:
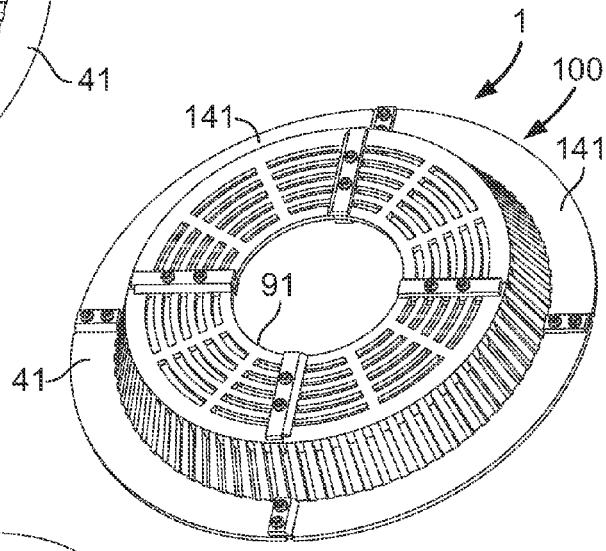
FIG. 23 is a perspective view of the sump pump guard adaptor of FIG. 22.
Figure 24:
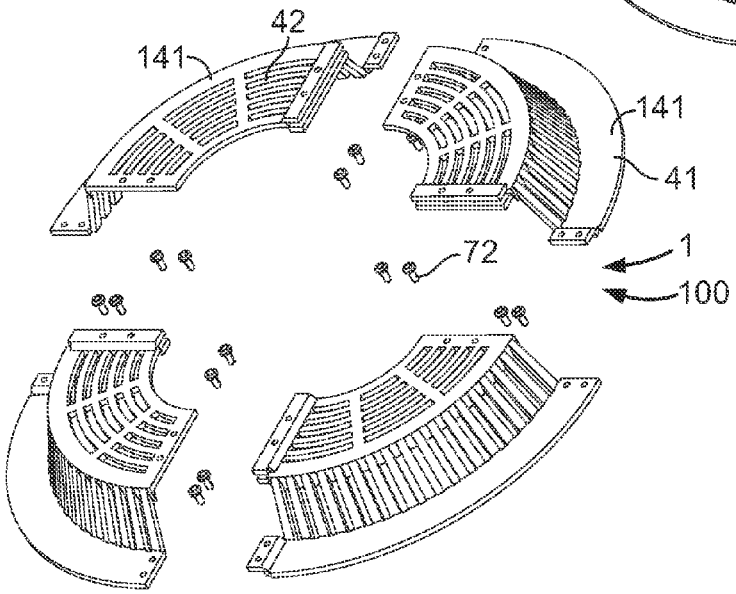
FIG. 24 is an exploded view of the sump pump guard adaptor of FIGS. 22 and 23.

When the body 100 is made of more than one piece as shown at FIGS. 22-24, the first collar 91 is located on more than one piece 141, the method further includes the step of sliding the casing of the pump 10 inside of the first collar 91 during the assembly of the more than one piece 141 into the body 100 and forming the first collar 91 before sliding the casing inside of the first collar 91. Finally, the method may include the step of adapting the horizontal lip 41 to either the base 200 or to a bottom of the sump pit 166.

Figure 29:
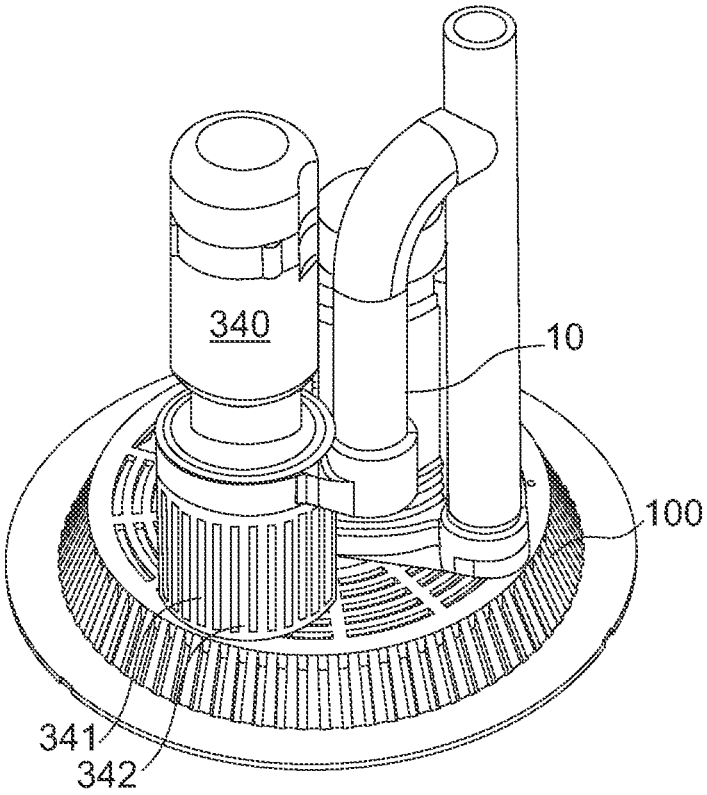
FIG. 29 is a perspective view of another sump pump guard adaptor with a secondary pump support according to another embodiment of the present disclosure.
Figure 30:
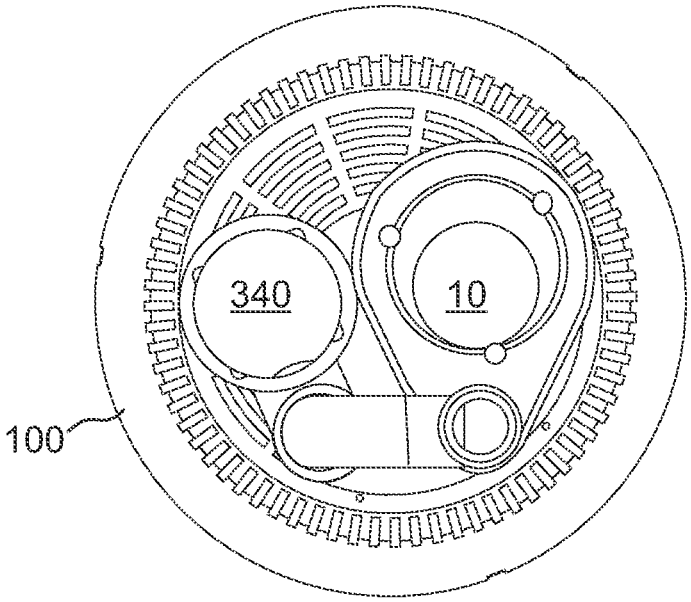
FIG. 30 is a top view of the sump pump guard adaptor shown at FIG. 29.
Figure 31:
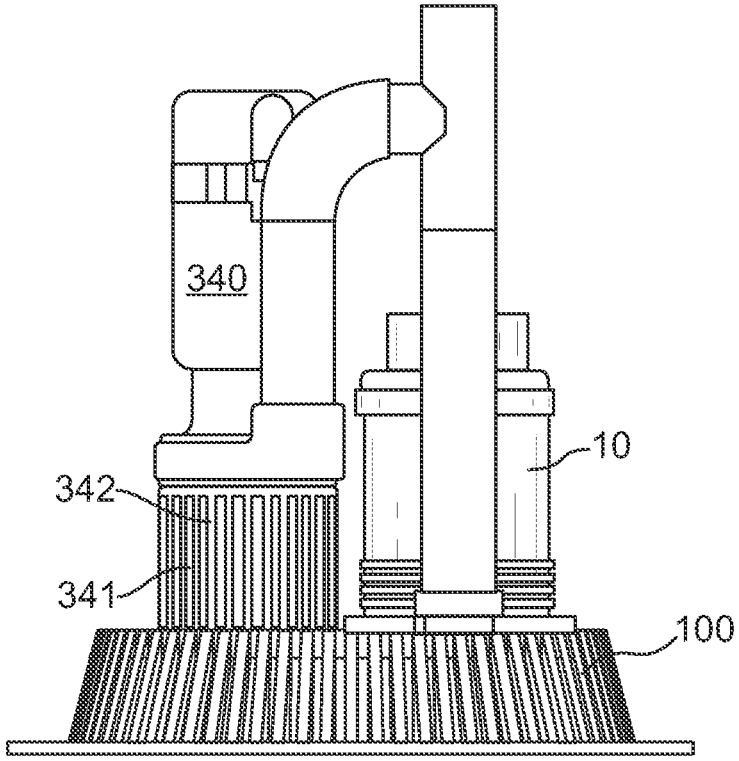
FIG. 31 is front view of the sump pump guard adaptor shown at FIG. 29.

In FIGS. 29-31 is shown another embodiment a back up pump 340 configured to rest alongside the primary pump 10 instead of being vertically stacked as shown at FIGS. 9-10. In this configuration, as shown, the secondary pump or back up pump 340 is placed on a secondary pump holder 341 shown as a cylinder also with flow openings 342. While the secondary pump holder 341 is shown as a piece that may be stacked upon the body 100, the holder 341 can also be directly manufactured as part of the body without or without flow openings 342. Further, the pump 340 can also be acquired directly with a designed holder. As for the body 100, the secondary pump holder 341 can be made with several segments or can also include different supporting elements, holders, or attachments (not shown). The secondary pump holder 341 can also be made of a structure for holding a mesh (not shown).

Persons of ordinary skill in the art appreciate that although the teachings of this disclosure have been illustrated in connection with certain embodiments and methods, there is no intent to limit the invention to such embodiments and methods. On the contrary, the intention of this disclosure is to cover all modifications and embodiments falling fairly within the scope the teachings of the disclosure.

What is claimed is:

1. A method of adapting a pump guard adaptor to a sump pump, the method comprising the steps of:

selecting a sump pump with an inlet and a casing, the casing having a first external shape, selecting a pump guard adaptor with a body and a plurality of flow openings on the body for covering the inlet within the body, the pump guard adaptor having a first collar for adaptation to the first external shape, and having an external edge for adaptation to an internal surface of a sump pit, sliding the casing inside of the first collar, and sliding sump pump with the pump guard adaptor in the internal surface of the sump pit.

2. The method of claim 1, wherein the first collar further comprises adaptor elements, and wherein the method includes the step of cutting or bending the adaptor elements to open the first collar to the size of the casing before the step of sliding the casing inside of the first collar.

3. The method of claim 1, wherein the external edge comprises tab elements, and wherein the method includes the step of cutting or bending the tab elements to narrow the external edge for adaptation to the internal surface of the sump pit before the step of sliding the sump pump with the pump guard adaptor in the internal surface of the sump pit.

4. The method of claim 1, wherein the body of the pump guard adaptor includes a top portion and a base, and wherein the first collar is on the top portion, and wherein the method further includes the step of attaching the base to the top portion after the step of sliding the casing inside the first collar.

5. The method of claim 4, wherein the external edge includes a horizontal lip, and wherein the method includes the final step of adapting the horizontal lip to either the base or to a bottom of the sump pit.

6. The method of claim 1, wherein the body is made of more than one piece and the first collar is located on more than one piece, and wherein in the method, the step of sliding the casing inside of the first collar includes the step of assembling the more than one pieces into the body and forming the first collar before sliding the casing inside of the first collar.

7. The method of claim 1, wherein the method further includes the step of selecting a second pump and a secondary pump support and adapting the secondary pump support to the second pump.

8. A sump pump guard adaptor for a sump pump with an inlet, the adaptor comprising a body with an inside surface for covering an inlet of a sump pump on which the body is adapted, the body including a plurality of flow openings between the inside surface and an outside surface on the body, a first internal collar also between the inside surface and the outside surface for the adaptation of the body to a casing of a sump pump, an external edge for adaptation of the body to a base or a bottom surface of a sump pump pit, wherein a transitory volume defined between the inside surface of the body and either the base or the bottom surface of the sum pump pit and the flow openings define a filter between the outside surface and the inlet.

9. The sump pump adaptor of claim 8, wherein the first internal collar further comprises adaptor elements.

10. The sump pump adaptor of claim 8, wherein the external edge comprises tab elements.

11. The sump pump adaptor of claim 8, wherein the body of the pump guard adaptor includes a top portion and a base, and wherein the first collar is on the top portion.

12. The sump pump adaptor of claim 11, wherein the body further includes an ejector pipe adaptor between the inside surface and the outside surface and also includes a second pipe adaptor on the base for the passage of a pipe from a second pump staked below the sump pump adaptor.

13. The sump pump adaptor of claim 11, wherein the top portion or the base includes a locking mechanism for securing the base to the top portion.

14. The sump pump adaptor of claim 8, wherein the body is made of more than one piece and the first collar is located on more than one piece.

15. The sump pump adaptor of claim 8, wherein the body further includes an ejector pipe adaptor between the inside surface and the outside surface.

16. The sump pump adaptor of claim 8, wherein the inside surface is adapted to be nested to the outside surface of a second sump pump adaptor for storage and display.

17. The sump pump adaptor of claim 8, wherein at least a flow opening of the flow openings is configured to allow a strap to be slid to secure the body to either the pump or the sump pit.

18. The sump pump adaptor of claim 8, further comprising a secondary pump support.

19. A kit for securing a sump pump guard adaptor for a sump pump with an inlet to a pump, the kit comprising:

an adaptor comprising a body with an inside surface for covering an inlet of a sump pump on which the body is adapted, the body including a plurality of flow openings between the inside surface and an outside surface on the body, a first internal collar also between the inside surface and the outside surface for the adaptation of the body to a casing of a sump pump, an external edge for adaptation of the body to a base or a bottom surface of a sump pump pit, wherein a transitory volume defined between the inside surface of the body and either the base or the bottom surface of the sum pump pit and the flow openings define a filter between the outside surface and the inlet, wherein either the first opening further comprises adaptor elements, or the external edge comprises tab elements, and a tool for cutting either the adaptor elements or the tab elements.

20. The kit of claim 19, wherein at least a flow opening of the flow openings is configured to allow a strap to be slid to secure the body to either the pump or the sump pit, and the kit further includes a strap.

21. The kit of claim 19, wherein the adaptor includes the body and a base.

22. The kit of claim 19, wherein the body is made of more than one piece.

23. The kit of claim 19 further including a second adaptor.

24. A system for adapting a pre-screen to the inlet of a pump, the pre-screen comprising a body with an inside surface for covering an inlet of a pump on which the body is adapted, the body including a plurality of flow openings between the inside surface and an outside surface on the body, a first internal collar also between the inside surface and the outside surface for the adaptation of the body to a pump casing, an external edge for adaptation of the body to a base or a bottom surface of a basin.

25. The system of claim 24, wherein the first opening further comprises adaptor elements.

26. The system of claim 24, wherein the external edge comprises tab elements.

27. The system of claim 24, wherein the body of the pre-screen includes a top portion and a base, and wherein the first collar is on the top portion.

28. The system of claim 24, wherein the body is made of more than one piece and the first collar is located on more than one piece.

29. The system of claim 24, wherein the body further includes an ejector pipe adaptor between the inside surface and the outside surface.

* * * * *